United States Patent [19]

Nava

[11] 4,242,757

[45] Jan. 6, 1981

[54] HELMET WITH TILTABLE VISOR

[76] Inventor: Pierluigi Nava, Via Dogana 1, Milan, Italy

[21] Appl. No.: 915,376

[22] Filed: Jun. 14, 1978

[30] Foreign Application Priority Data

Jan. 11, 1978 [IT] Italy ..... 19178 A/78

[51] Int. Cl.[3] ..... A42B 3/02

[52] U.S. Cl. ..... 2/10

[58] Field of Search ..... 2/10, 424, 6, 9, 423, 2/427, 436, 437

[56] References Cited

U.S. PATENT DOCUMENTS

| | | | |
|---|---|---|---|
| 3,797,042 | 3/1974 | Gager, Jr. | 2/10 |
| 4,100,619 | 7/1978 | Piech et al. | 2/10 |

FOREIGN PATENT DOCUMENTS

| | | | |
|---|---|---|---|
| 862776 | 5/1978 | Belgium . | |
| 2801510 | 7/1978 | Fed. Rep. of Germany . | |
| 2338005 | 8/1977 | France | 2/10 |
| 7611248 | 4/1977 | Netherlands | 2/424 |
| 995665 | 6/1965 | United Kingdom | 2/10 |

*Primary Examiner*—Werner H. Schroeder
*Assistant Examiner*—A. Falik
*Attorney, Agent, or Firm*—Blanchard, Flynn, Thiel, Boutell & Tanis

[57] ABSTRACT

The helmet, at its face opening, is provided with a peripheral abutment in which the edge of a transparent shield is housed, such that the visor when closed is flush with the surface of the helmet. Such shield is connected to the helmet structure by articulation members which are connected to members such as multiple hinges comprising links or the like. The length of the hinge members can be varied to allow the shield to be moved away and removed from the peripheral abutment and then tilted.

19 Claims, 14 Drawing Figures

FIG. 7
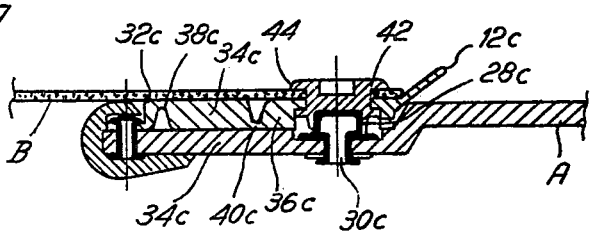
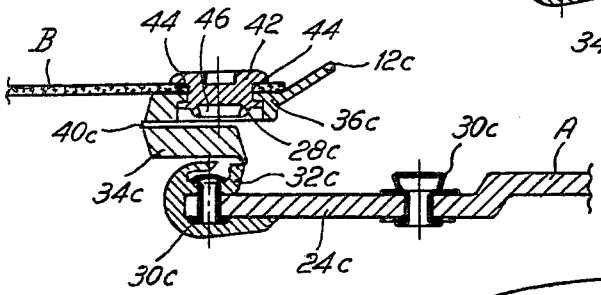
FIG. 8
FIG. 9
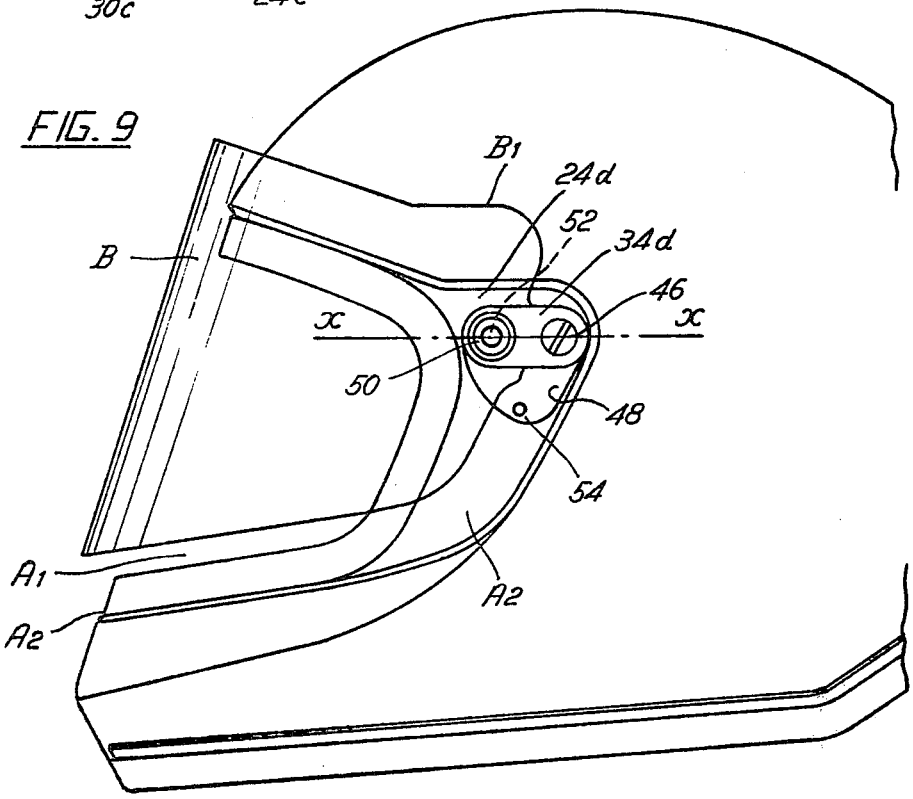
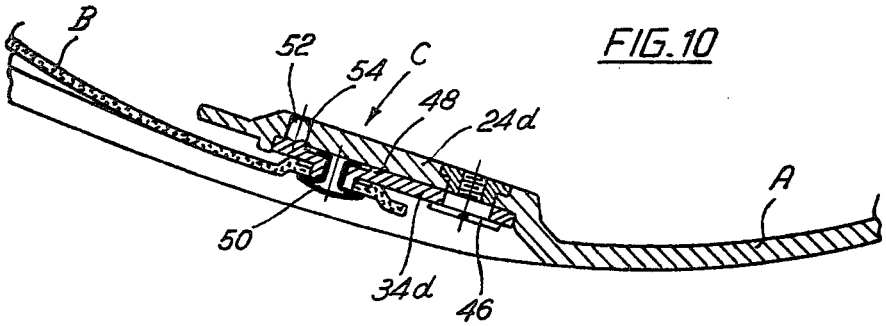
FIG. 10

HELMET WITH TILTABLE VISOR

The present invention relates to an helmet, and particularly a protective helmet having a tiltable visor which finds a particular, but not exclusive application for sporting purposes, for example for motorcyclists.

Protective helmets provided with a transparent visor or shield, which, if necessary, can be brought into a position which clears the face opening provided in said helmet, are known. These helmets do not meet the desired requirements since the edge of the visor always protrudes from the outline of the helmet.

A purpose of the invention is to provide a protective helmet, provided with a tiltable visor which, when it is in the lowered or operative position, has its edge which does not protrude from the outer surface of the helmet and thus forms a fairing or profile not having projecting parts and accordingly fully meeting the security requirements.

Another purpose of this invention is to provide an helmet having a tiltable visor which, at the lowered or operative position is kept and secured in said position.

The helmet provided with a transparent visor or shield, in accordance with the invention, is characterized in that the edge of the opening of the helmet has an abutment which houses the edge of the transparent shield and such shield is connected to the structure of said helmet by means of suitable articulation or hinge members, at least one of the arms of which is combined with members for varying the length thereof so that the transparent shield, at the lowered position, may be moved away from said abutment and then turned over. This concept, in practice, is susceptible of various embodiments all of which are in the field of this invention.

To the purpose of securing the transparent shield in the housing provided by the peripheral abutment of the edge of the opening, one of the two end elements of each multiple hinge has a shaped head cooperating with a respective springed cup forming the locking member which secures the elements of said hinge in the lowered position.

The invention will now be explained by making reference to the following description in connection with the accompanying drawings which illustrate, by way of examples, some embodiments of the helmet according to the invention and more precisely:

Figure 4:
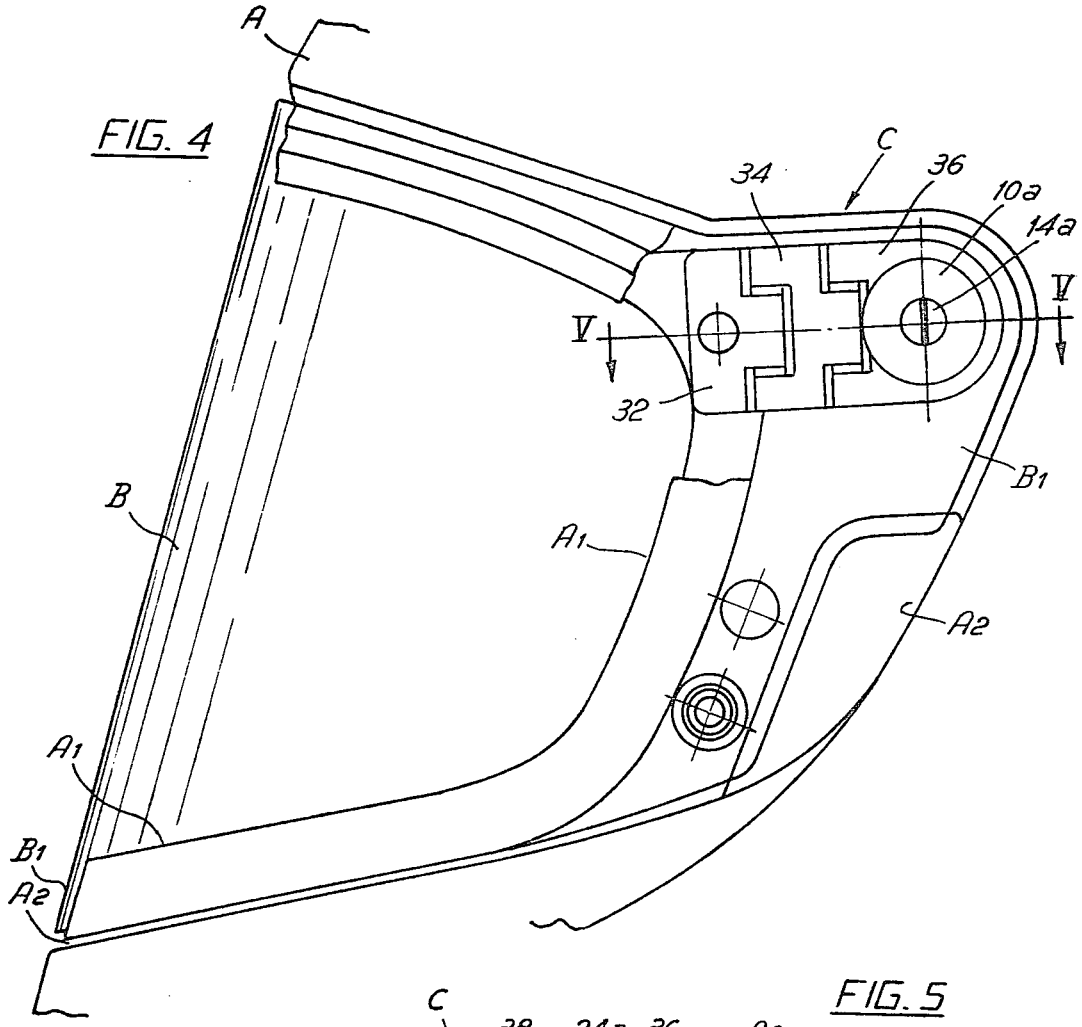
FIG. 4 is a fragmentary side elevation view of a second embodiment of the helmet.
Figure 5:
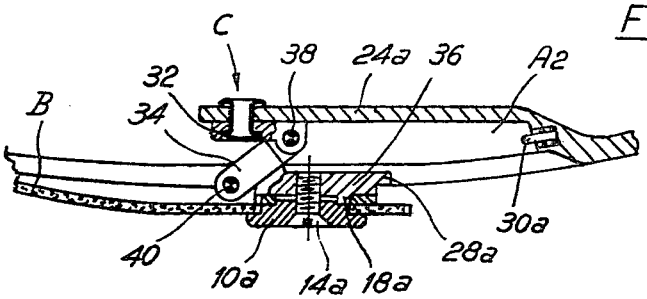
FIG. 5 shows a cross-section made on line V—V in FIG. 4, in which the visor is shown in a position intermediate the two end positions.
Figure 6:
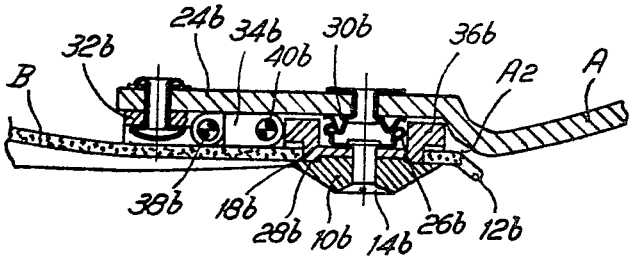
Figure 11:
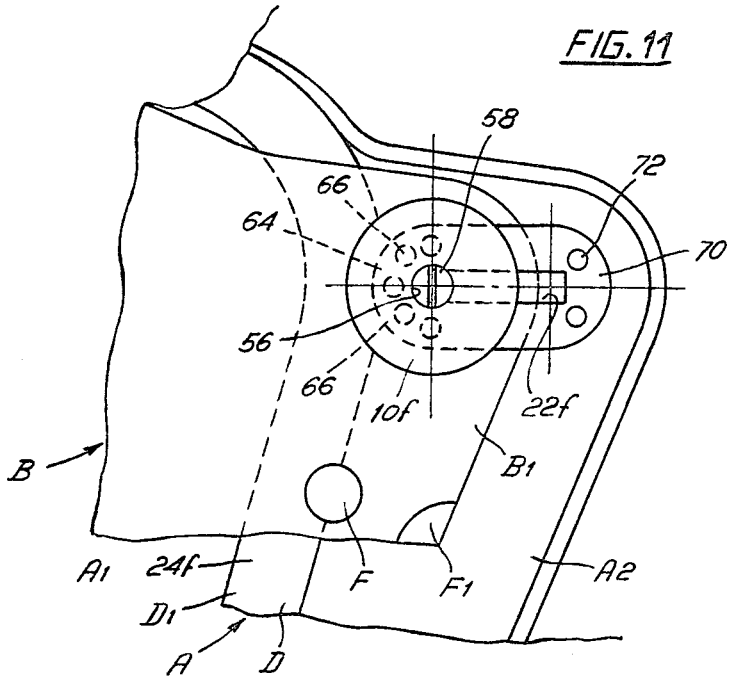
Figure 12:
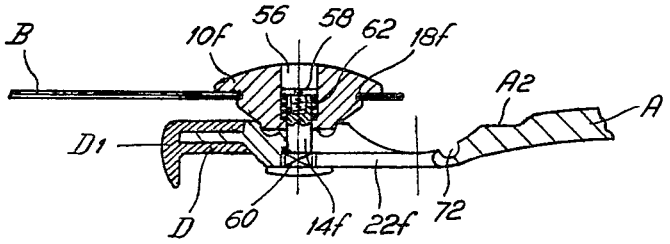
Figure 13:
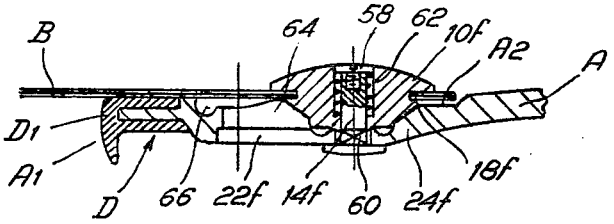
Figure 14:
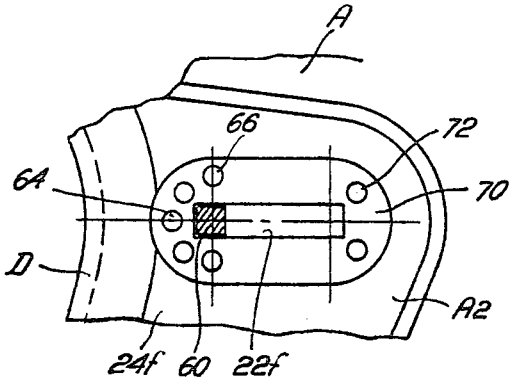

FIG. 6, like FIG. 5, shows a fragmentary cross-section view of another embodiment of the helmet;

FIGS. 7 and 8 are horizontal cross-section views of a further embodiment of the hinge which connects the visor to the helmet structure;

FIG. 9, like FIG. 4, shows in side elevation another modification of the helmet;

FIG. 10 is a cross-section made on line X—X in FIG. 9;

FIG. 11 is a detail, in fragmentary side elevation view, of another modification of the helmet in which the visor is shown in a lowered position and moved away from the opening of such helmet;

FIG. 12 is a cross-section on a line passing on the hinge pins of the visor of FIG. 11;

FIG. 13, like FIG. 12, shows the visor lowered and housed in the peripheral abutment of the helmet; and FIG. 14 is a detail of FIG. 11, where the visor is removed for a clear representation.

Figure 1:
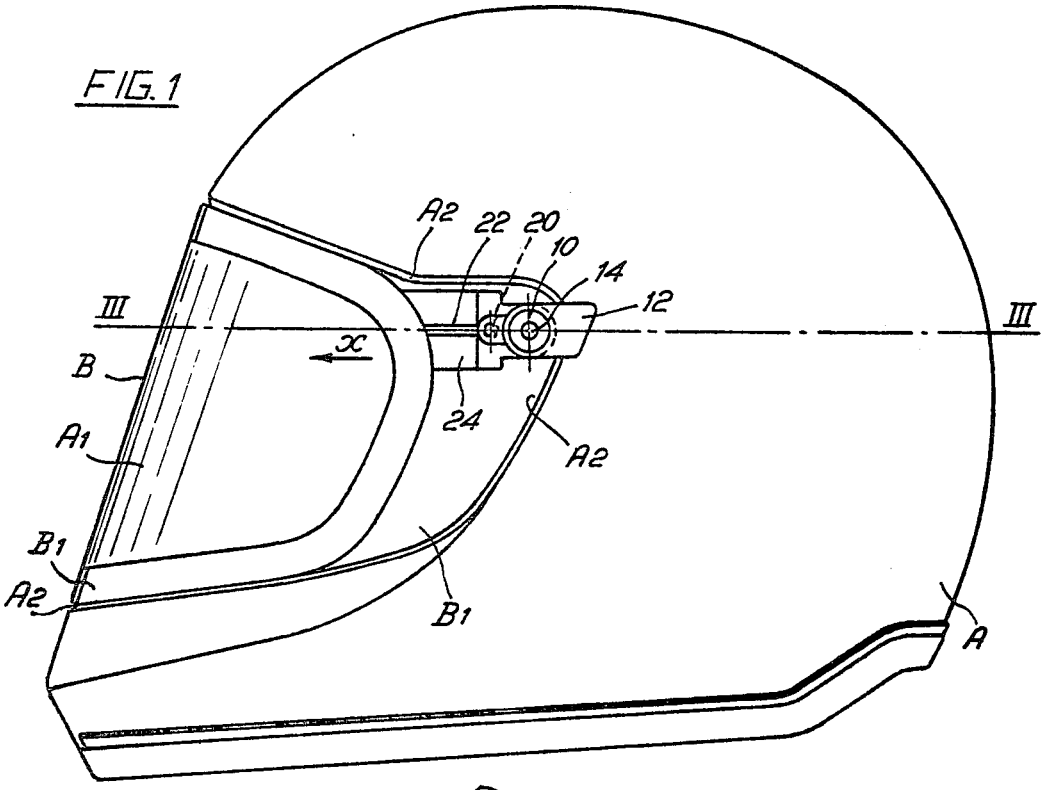
FIGS. 1 and 2 show in side elevation a first embodiment of the helmet according to this invention, with the visor in two positions.
Figure 2:
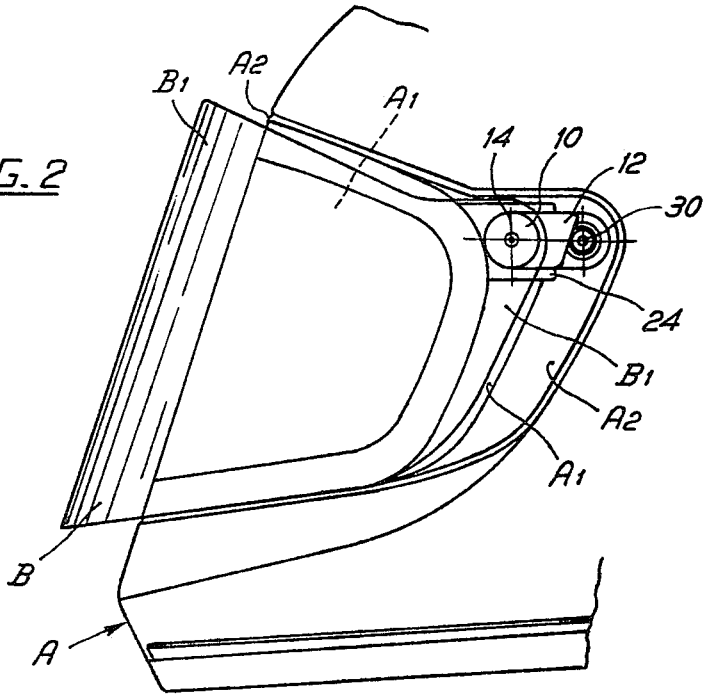
Figure 3:
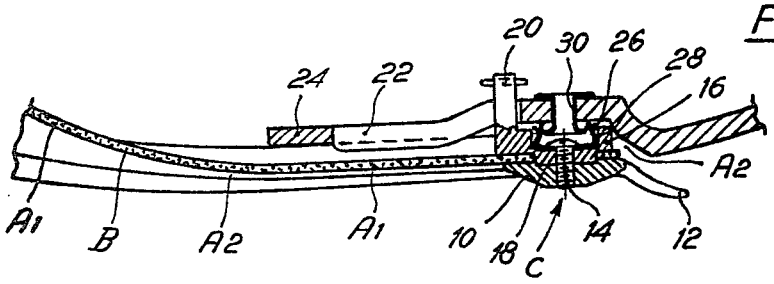
FIG. 3 shows a detail, in cross-section made on line III—III in FIG. 1.

Considering now FIGS. 1 to 3 of the drawings, the helmet illustrated comprises a body A provided forwardly with an opening A1 shaped in conformity to the face of the user. The shaped opening A1 is provided with a transparent shield or visor B, the perimetral edge B1 of which projects by some extent from the inner edge of said opening A1 and has, at its border, a peripheral abutment A2, in the form of an outward facing peripheral recess, in which the edge B1 of the transparent shield B is housed. The depth of peripheral abutment, or recess, A2 is substantially equal to the thickness of shield B so that, when such shield is lowered, its profile exactly completes that of helmet A.

Due to the conditions of engagement of transparent shield B with helmet A, such shield is removably coupled to the latter by hinge or articulation members C which allow said shield to have two movements in sequence, the first of which, assuming the shield to be in the lowered position, is a rectilinear horizontal movement and the second one is a swinging movement from the bottom upward to thus completely clear shaped opening A1 of helmet A.

Referring again to FIGS. 1 and 2, each of hinge members C have a domed circular plate 10 laterally provided with a tongue 12 which forms a grasping member; said plate, at its central portion, is provided with a screw 14 which retains a back plate 16 provided with a cylindrical boss 18 forming a pivot pin engaged within a bore in shield B to hinge the latter to helmet A.

Back plate 16 is provided, at a position diametrally opposite tongue 12, with a pin 20 which slidably engages a horizontal slot 22 in a laminar protrusion 24 integral with or inserted on the edge of opening A1 of the helmet. In addition back plate 16 is provided with an abutment 26 in which a resilient cup 28 is housed, the resilient edges thereof engaging the cooperating edges of a back cup 30 secured to protrusion 24. Portions 28–30 form the elements of a resilient locking member which is opened or unlocked by acting on tongue 12 to disengage cup 28 from back cup 30.

It results that shield B may be displaced as indicated by arrow X to clear its edge B1 from abutment A2 provided at the border of opening A1 of the helmet. The closure of said opening is realized by an inverse action so that, when shield B is housed in abutment A2, it is herein locked by the mutual engagement of said cups 28–30.

The helmet shown in FIGS. 4 and 5 is similar to the helmet of the first embodiment and the like parts are designated by like references. In this modification, hinge members C are formed by multiple hinges, one of said elements 32 being secured to a protrusion 24*a* of opening A1 of helmet A.

The other elements 34 and 36 of this multiple hinge are hinged between each other by respective pivot pins 38 and 40 and the last of said elements has, on one of its faces, a cylindrical boss 18*a* which hinges the transparent shield B.

Such shield is fastened to multiple hinge 32–36 by a tightening screw 14 *a* or through the interposition of a washer 10*a*.

According to this modification, shield B is kept in the closed and lowered position by a resilient finger 30*a* in helmet A which engages a respective shaped ledge 28*a* on the movable element 36 of the double hinge 32–36.

According to the modification illustrated in FIG. 6 the transparent shield B is connected to the helmet A by means of multiple hinges 32*b*–34*b*–36*b*. According to this modification, the end element 36*b* of each of said hinges has a resilient cup 28*b* resiliently engaging the crown of a back cup 30*b* secured to a protrusion 24*b* of helmet A.

FIGS. 7 and 8 show in cross section and with the shield in the closed and opened positions, one of the two hinge members C for said shield B, each formed by a multiple hinge 32*c*–34*c*–36*c* fully made of molded plastic material; its elements are connected to each other by flexible straps or ledges 38*c* and 40*c*. Moreover the end element 36*c* of said hinge is bored in a suitable way so as to form one of the elements of a bayonet joint or the like, while the other element of said joint is formed by a button 42 also made of plastic material having a suitable elasticity. The complementary element of the bayonet joint is formed by two or more sections 44 realized in the periphery of the button 42 which retain the bored end of the transparent shield B so that the latter can be caused to swing.

Moreover, the button 42 has, on its free face, a tapered crown 28*c* which engages resiliently the back crown 30*c* secured to the protrusion 24*c* of helmet A and a tongue 12*c* by means of which the user disengages said crown from the back crown 30*c* to move the transparent shield B away from the opening A1 of the helmet, such operation being carried out in the manner already explained. The helmet illustrated in FIGS. 9 and 10 is provided with hinge or articulated members C having multiple hinges, the end elements of which are formed by portions of helmet A and by transparent shield B. More precisely, each of said members C is formed by a link 34*d* of resilient material, one of the ends of which is kept by a pivot pin 46 against the bottom of an abutment 48 provided in the side wall 24*d* of helmet A within which said link may swing.

The other end of said link 34*d* is hinged by means of a pivot pin 50 to the respective bored end of the transparent shield B. Link 34*d*, beyond pivot pin 50, has a domed boss which engages one of the upper and lower bores 54 both provided in the bottom wall of said abutment 48 to thus position the transparent shield B.

It results from the foregoing that edge B1 of shield B is kept adherent to the bottom of the peripheral abutment A2 due to the engagement of the domed boss 52 in the lower bore 54. By acting on the head of pivot 50 in the direction of arrow Y in FIG. 9, the user disengages the boss 52 from the lower bore 54 and carries it in engagement with the upper bore, and this displacement causes the shield B to be displaced in the direction of arrow Y while disengaging the edge B1 of said shield from the abutment A2 of helmet A. Link 34*d* is kept in this position due to the engagement of bosses 52 within the upper bores 54 and shield B may be caused to be swung upward to make the opening A1 completely free. With reference to FIGS. 11–14, visor B is connected to the helmet by means of hinge members C provided at its ends which permit said visor B to make composite displacements, that is rectilinear and pivoting displacements between the end positions shown in FIG. 13 (lowered position) and in FIG. 12 (lifted position).

Each one of said hinge members C is provided with a shaped head 10*f* suitably connected to the respective end of visor B which, for this purpose, is bored to engage in annular slot 18*f* in head 10*f* which forms, in this manner, one of the pivot pins of the visor.

Head 10*f* is provided, at its axis, with a step bore 56 which houses the head of a lock screw 58 engaged with the end of a pivot pin 14*f* which terminates at its other end by a polygonal head 60. Step bore 56 and lock screw 58 retain a coil spring 62 fitted on the terminal portion of pivot pin 14*f*; the polygonal head 60, provided by such pivot pin 22*f*, is slidably housed in a slot 24*f* made in end tongue 24*f* so that the action of spring 62 approaches and resiliently presses the end of visor B and said tongue 24*f* to each other.

The outer edge of slot 22*f* has, toward the front end (that is the left end in FIGS. 12 and 13) a boss 64, the rear end of which forms an inclined plane which thus connects said boss with the face of tongue 24*f*. Boss 64, at its arcuated flat extremity provides a plurality of notches 66, arranged along an arc, in which notches one or two hemispherical bosses resiliently engage, said bosses being formed on the lower face 68 of head 10*f*. A resilient locking member is thus realized in order to position visor B in a predetermined and desired position.

The other end 70 of slot 20*f*, which is opposite boss 64, terminated by a semicircular flat surface which, at its diameter, provides notches 72 in which the hemispherical bosses, on the lower face 68 of head 10*f*, engage themselves to keep visor B in the lowered and retracted position.

To firmly maintain visor B in the lowered and retracted position, the helmet is provided with lock members F which, in the case illustrated, comprise known resilient buttons.

The two elements of each one have resilient crowns which may be resiliently coupled to each other by pressure and which are secured, one to tongue 24*f* of the body and the other to the end of visor B in a position adjacent to hinge C.

In order to facilitate the engagement and disengagement operations of the two elements of each locking button F, the edge of visor B in proximity of the locking members F has arcuated notches F1 in which the user can engage or introduce the tips of his thumbs to exert a lever action and separate the resilient crowns of said locking buttons and lift the end of the visor from the button wall A2.

Visor B (connected to the helmet by hinging members C which realize a friction resilient action between each other caused by springs 62), once disengaged from opening A1, can be tilted and kept in any of the intermediate positions between the horizontal position corresponding to the lowered position remote from the peripheral abutment A2 and the position of maximum lifting where the upper edge of said visor engages the top of the helmet.

Thus to eliminate or reduce the drawbacks caused to the user by the corners presented by the opening A1 of the helmet, at least a portion of the edge of said opening is provided with resilient gasket D formed by a channel-shaped section ending with an enlarged edge D1 which thus defines the opening of the helmet.

So as to carry out the helmet now set forth, modifications and variations of these helmets could be provided;

for example the elements of hinge members C could be interchanged, that is sub-assembly 10f–14f may be connected to the tongue 24f while the slot 22f may be formed on the end of visor B.

It results from the foregoing that the objects of this invention are fulfilled in that the transparent shield B is fully housed in peripheral abutment A2 provided in the edge of opening A1 of helmet A. Moreover said shield B can assume, other than the closed and open positions, also an intermediate position in which such shield is suitably moved away from opening A1 of helmet A.

Modifications and variations could be made to the helmet of this invention so as to fulfill the use requirements and the like; for example the hinge members C could be provided with resilient means, the action of which maintains the edge of the transparent shield B adherent to peripheral abutment A2 of helmet A. Therefore, these variations will remain in the field of the present invention.

I claim:

1. A helmet assembly, in particular for motorcyclists and the like, comprising:

a helmet;

a transparent visor hinged to the helmet to removably cover an opening in the helmet, with the perimetral edge of the visor being housed in an outward facing peripheral recess defining the peripheral edge of said opening in said helmet, such that said visor is flush with and not projecting from the outer surface of the helmet; and hinging means located between the outer ends of said visor and said helmet, said hinging means including elongated guide means on said helmet extending along said helmet toward said peripheral edge of said helmet opening, and pivot means on said outer ends of said visor engaging said elongated guide means on said helmet and being movable forwardly therealong for guiding forward displacement of said visor out of said flush position on said helmet and into a position spaced forward of and disengaged from said peripheral recess, said elongated guide means including camming surfaces extending therealong and inclined to move the outer ends of the visor away from each other as said pivot means move forwardly therealong, said pivot means pivotally supporting said visor on said elongated guide means for swinging of said visor about a substantially horizontal axis.

2. The assembly of claim 1 in which said helmet includes tongues at the peripheral edge of said opening and cooperable with said hinging means for positively limiting forward movement of said visor away from said helmet.

3. The assembly of claim 1 in which said hinging means comprises a plate and backing plate and a clamping member pivotally interconnecting same together, the opposed faces of one of said plate and backing plate having a cylindrical boss retained in a bore in the adjacent end of the visor.

4. The assembly of claim 3 in which one of said plate and backing plate carries a pivot pin having an axis parallel to the pivot axis of said plate and backing plate, said helmet having a tongue opposing said end of said visor and carrying a slot in which said pivot pin is slidably engaged, said guide means and pivot means respectively comprising said slot and pivot pin.

5. The assembly of claim 1 in which said hinging means includes locking means for locking said visor in its flush, opening covering position, said locking means being formed by conventional resilient male and female cups fixed one to said helmet and the other to said visor.

6. The assembly of claim 1 in which the helmet includes tongues having parallel planes on opposite sides of the helmet at the periphery of the helmet opening, each said tongue retaining a respective hinging means, said guide means comprising a slot in each tongue, said pivot means including a pivot for said swinging of said visor about a substantially horizontal axis, said pivot being slidable along said slot to achieve said displacement of said axis to disengage the visor from the helmet opening.

7. The assembly of claim 6 in which said slot in said tongue is horizontal, said pivot having a polygonal head slidably and nonrotatably engaged in said slot, said hinging means further including resilient locking members providing a frictional interengagement between relatively movable surfaces associated with said visor and helmet to resiliently maintain said visor in a predetermined position on said helmet.

8. The assembly of claim 7 in which the front part of said slot in said tongue includes an inclined plane engageable with the portion of said resilient locking members on said visor for allowing disengagement of the visor from said peripheral recess bounding said helmet opening, said inclined plane defining the corresponding one of said camming surfaces.

9. The assembly of claim 6 in which each said end of the visor carries a head, said head being bored to receive said pivot and a coil spring engaged between said head and said pivot for resiliently urging said head against the surface of said helmet.

10. The assembly of claim 9 in which said head has on its face opposing said helmet at least a hemispherical boss engageable with one of a plurality of notches arranged along arcs at opposite ends of said slot in said helmet tongue.

11. The assembly of claim 6 including coacting locking members respectively fixed to the helmet tongue and the overlying end of the visor and mutually engageable to maintain said visor in said peripheral recess of the helmet opening, the edge of said visor adjacent the corresponding locking member having an arcuated notch graspable by the user to move the visor away from the helmet surface for thereafter permitting said displacement and swinging of said visor with respect to said helmet.

12. A helmet assembly, in particular for motorcyclists and the like, comprising:

a helmet;

a transparent visor hinged to the helmet to removably cover an opening in the helmet, with the perimetral edge of the visor being housed in an outward facing peripheral recess defining the peripheral edge of said opening in said helmet, such that said visor is flush with and not projecting from the outer surface of the helmet; and hinging means located between the outer ends of said visor and said helmet, said hinging means including a multiple element hinge connecting each visor outer end to said helmet, said multiple element hinge having end elements fixed with respect to said visor outer end and helmet and hingedly connected through a pair of hinge axes by at least one intermediate element rotatable on said pair of hinge axes for guiding forward displacement of said visor out of said flush position on said helmet and into a position spaced forward of and disengaged from said peripheral recess, said hinging means further supporting said visor for swinging of said visor about a substantially horizontal axis.

13. The assembly of claim 12 in which said hinging means has its multiple elements hinged in series between said helmet and visor, and including locking means on one of said hinge elements for locking said visor in its flush position covering said helmet opening.

14. The assembly of claim 12 in which said hinging means has its multiple hinge elements in series connecting the visor end to said helmet for said displacement of said horizontal axis, each end of said visor having a bore, the adjacent one of said hinge elements having a boss engaged in said bore and retained therein by a clamping member.

15. The assembly of claim 14 in which said multiple element hinge has its hinge axes extending in a direction substantially perpendicular to the axis of said bore and boss, said bore and boss defining said substantially horizontal axis about which said visor can swing.

16. The assembly of claim 12 in which said end elements of said multiple element hinge are integral portions of said visor and helmet respectively, and said intermediate element is directly connected through separate pivots at said pair of hinge axes to said visor and to said helmet.

17. The assembly of claim 16 in which said hinging means includes locking means for releasably fixing said visor in its flush position covering said opening in said helmet, said intermediate element of said hinging means supporting said visor on said helmet at least for said displacement of said horizontal axis to disengage the visor from said helmet opening, said locking means being formed by a boss and cooperating notch provided on said intermediate element of said hinging means and on the opposed surface of said helmet, said boss being interposed between said helmet and visor during said forward displacement of said visor for moving the outer ends of said visor away from each other, said intermediate element being pivoted about one said hinge axis on said helmet for movement in a plane parallel to said helmet surface, the other said hinge axis being coaxial with said horizontal axis.

18. The assembly of claim 12 in which at least one of the hinge axes is formed by a flexible plastic material.

19. The assembly of claim 12 in which said hinging means includes means for locking said visor in its flush position covering said helmet opening, said locking means comprising a resilient boss cooperating with a nose, wherein said resilient boss and nose are fixed to said helmet and visor.

* * * * *